US005574994A

United States Patent [19]

Huang et al.

[11] Patent Number: 5,574,994

[45] Date of Patent: Nov. 12, 1996

[54] METHOD OF CORRECTING CARRIER LEAK IN A TRANSMITTER

[75] Inventors: Ping Huang, Chiba; Yumi Hachisuka, Matsudo; Kiyoshi Tanaka, Chiba, all of Japan

[73] Assignee: Uniden Corporation, Chiba, Japan

[21] Appl. No.: 379,810

[22] Filed: Jan. 27, 1995

[30] Foreign Application Priority Data

Jul. 15, 1994 [JP] Japan ..... 6-164285

[51] Int. Cl.[6] ..... H01Q 11/12

[52] U.S. Cl. ..... 455/126; 455/115; 330/149; 332/107; 375/296

[58] Field of Search ..... 455/126, 127, 455/113, 114, 115, 118, 119, 75; 375/296, 297; 332/103, 107; 330/149, 129

[56] References Cited

U.S. PATENT DOCUMENTS

| | | | |
|---|---|---|---|
| 4,700,151 | 10/1987 | Nagata | 332/18 |
| 4,933,986 | 6/1990 | Leitch | 455/119 |
| 5,351,016 | 9/1994 | Dent | 332/103 |
| 5,381,108 | 1/1995 | Whitmarsh et al. | 330/2 |
| 5,396,196 | 3/1995 | Blodgett | 332/103 |
| 5,404,378 | 4/1995 | Kimura | 375/296 |
| 5,469,105 | 11/1995 | Sparks | 330/129 |

FOREIGN PATENT DOCUMENTS

| | | |
|---|---|---|
| 58-88907 | 5/1983 | Japan . |
| 61-214843 | 9/1986 | Japan . |
| 1-317032 | 12/1989 | Japan . |
| 4-257126 | 9/1992 | Japan . |
| 5-37318 | 2/1993 | Japan . |

*Primary Examiner*—Andrew Faile
*Assistant Examiner*—Lee Nguyen
*Attorney, Agent, or Firm*—Lowe, Price, LeBlanc & Becker

[57] ABSTRACT

A method of suppressing generation of carrier leak in a transmitter and reducing deterioration of communication quality comprises the steps of outputting DC elements (I, Q) from a DSP gradually changing the voltage values, measuring a sum of the DC elements ($\Delta I_{DC}$, $\Delta Q_{DC}$) and DC elements (I, Q), storing the DC elements (I, Q), when the above sum is equal to a specified value (herein, 0 V), as DC elements $-\Delta I_{DC}$, $-\Delta Q_{DC}$ for correction, and correcting the DC elements ($I_{DC}$, $Q_{DC}$) (DC elements obtained by amplifying DC elements for (I, Q) channels demodulated by a quadrature demodulator during transmission) using the DC elements ($-\Delta I_{DC}$, $-\Delta Q_{DC}$) for correction during transmission.

9 Claims, 3 Drawing Sheets

METHOD OF CORRECTING CARRIER LEAK IN A TRANSMITTER

FIELD OF THE INVENTION

The present invention relates to transmitter such as a high output linear amplifier/transmitter in radio communications, and more particularly to a method of correcting carrier leak in a transmitter by correcting carrier leak from a demodulator in a Cartesian loop transmitter and/or correcting carrier leak in a demodulator.

BACKGROUND OF THE INVENTION

A Cartesian loop transmitter is used as a high output linear amplifier/transmitter. FIG. 3 shows an example of configuration of a conventional type of Cartesian loop transmitter comprising a DSP 301 (digital signal processor) which executes processing for an input signal such band limitation, band division and frequency shift, all required for tone-in-band generation. An output of the DSP signal is divided to two signals I and Q crossing each other at right angles, and applied to D/A convertors 302, 303 which convert the output signals I, Q (digital signals) from the DSP 301 to analog signals respectively. An LPF (low pass filter) 304 receives the signal from the D/A convertor 302 together with a signal $I_{DC}$ from an operational amplifier 313, described later, and subjects the signals to band limitation and then outputs the signal. An LPF 305 receives a signal from the D/A convertor 303 together with a signal $Q_{DC}$ from an operational amplifier 314, described later, subjects the signals to band limitation and then outputs the signals. A local oscillator 306 outputs a local signal (carrier wave) $L_O$, and a quadrature modulator 307 receives signals from the LPFs 304, 305 and local oscillator 306 and outputs modulated wave after quadrature modulation. A power amplifier 308 amplifies the modulated wave outputted from the quadrature modulator 307. An antenna 309 transmits the modulated wave amplified in the power amplifier 308. An ATT (attenuator) 310 detects only a progressive wave from the modulated wave amplified in the power amplifier 308 and executes attenuation for level adjustment. A local oscillator 311 outputs a local signal (carrier wave) $L_O$, and a quadrature modulator 312 into which signals from the ATT 310 and the local oscillator 311 are inputted, subjects the signals to quadrature demodulation. An operational amplifier 313 amplifies signals from the quadrature demodulator 312 and outputs a signal $I_{DC}$, and an operational amplifier 314 amplifies the signals from the quadrature demodulator 312 and outputs a signal $Q_{DC}$. It should be noted that, in the figure, the reference numeral 315 indicates an adder while the reference numeral 316 indicates a multiplier.

As clearly indicated by the configuration described above, the Cartesian loop transmitter has a negative feedback circuit to return output from the quadrature modulator 307 via the quadrature demodulator 312 to an input terminal of the quadrature modulator 307 again, so that distortion due to non-linear amplification is reduced, and thus the function as an amplifier/transmitter is executed.

However, with the conventional type of Cartesian loop transmitter as described above, carrier (carrier wave) leak generated by the quadrature modulator and the quadrature demodulator is transmitted from the antenna as an unnecessary interference signal together with a transmission signal, so that communication quality is disadvantageously deteriorated.

Specifically, in the quadrature modulator, carrier leak is generated due to incomplete isolation to a local signal inputted from a local oscillator. Also due to incomplete isolation in the quadrature demodulator for feedback, a DC element in the I, Q channels is amplified, a carrier signal is generated as an input signal from the quadrature demodulator, and this carrier signal is generated as carrier leak at an output terminal of the quadrature demodulator.

SUMMARY OF THE INVENTION

It is an object of the present invention to suppress generation of carrier leak in a transmitter and to reduce deterioration of communication quality.

The method of correcting carrier leak in a transmitter according to the present invention comprises a first step of setting a first digital signal, based on data to be transmitted to a first specified value before start of transmission, a second step of causing an output from a demodulator to respond only to an output from a first local oscillator, a third step of comparing a third analog signal outputted from an adder to a second specified value and obtaining a result of comparison which is either a first state or a second state, and then a fourth step of causing the first digital signal to gradually change from the first specified value so that the result of comparison coincides with either the first state or the second state, obtaining a correction value indicating a difference between a value of the first digital signal and the first specified value at a time when the result of comparison coincides with either the first or the second state and storing the correction value. With the operations above, an appropriate correction value to carrier leak in a demodulator can be obtained. The method also comprises a fifth step of causing the first digital signal obtained by correcting data to be transmitted according to the correction value stored in the fourth step to be outputted from a DSP during transmission, and thus an appropriate correction to carrier leak in the demodulator is carried out.

In a method of correcting carrier leak in a transmitter according to the present invention, the second step above includes inhibiting the first supply circuit to supply the amplified modulated wave, and with this step, output from the demodulator is caused to respond only to the output from the first local oscillator.

In a method of correcting carrier leak in a transmitter according to the present invention, the demodulator is a circuit including a quadrature demodulator, and in this case appropriate correction to carrier leak due to incomplete isolation in the quadrature demodulator is performed.

The method according to the present invention comprises a first step of setting a first digital signal, based on data to be transmitted, to a first specified value, a second step of causing an output from a demodulator to respond only to an output from a first local oscillator, a third step of comparing a third analog signal outputted from an adder to a second specified value and obtaining a result of comparison which is either a first state or a second state, and then a fourth step of causing the first digital signal to gradually change from the first specified value so that the result of comparison coincides with either the first state or the second state, obtaining a first correction value indicating a difference between a value of the first digital signal and the first specified value at a point of time when the result of comparison coincides with either the first state or the second state, and storing the correction value. With the operations above, an appropriate correction value (first correction value) to carrier leak in a demodulator can be obtained. The operation also comprises a fifth step of causing the first digital signal to gradually change from the first correction value, outputting the first digital signal, obtaining a second correction value indicating a difference between a value of the first digital signal and the first correction value at a time when carrier leak outputted from the modulation circuit becomes the minimum, and storing the second correction value. With this operation, an appropriate correction value (second correction value) to carrier leak in the modulation circuit can be obtained. The operation also comprises a sixth step of causing the first digital signal obtained by subjecting the data to be transmitted to correction according to the first correction value stored in the fourth step and the second correction value stored in the step value to be outputted from a DSP during transmission, so that appropriate correction to carrier leak in a transmitter is executed.

In a method of correcting carrier leak in a transmitter according to the present invention, the second step includes inhibiting the first supply circuit to supply a modulated wave amplified as described above, and with this operation, output from a demodulator is caused to respond only to output from the first local oscillator.

In a method of correcting carrier leak in a transmitter according to the present invention, the modulation circuit is a circuit including a quadrature modulator, and in this case appropriate correction is executed to carrier leak in the quadrature demodulator.

Other objects and features of this invention will become understood from the following description with reference to the accompanying drawings.

DESCRIPTION OF THE PREFERRED EMBODIMENTS

A detailed description is made hereinafter for an embodiment of a Cartesian loop transmitter in which the method of correcting carrier leak according to the present invention is applied with reference to the related drawings.

Figure 1:
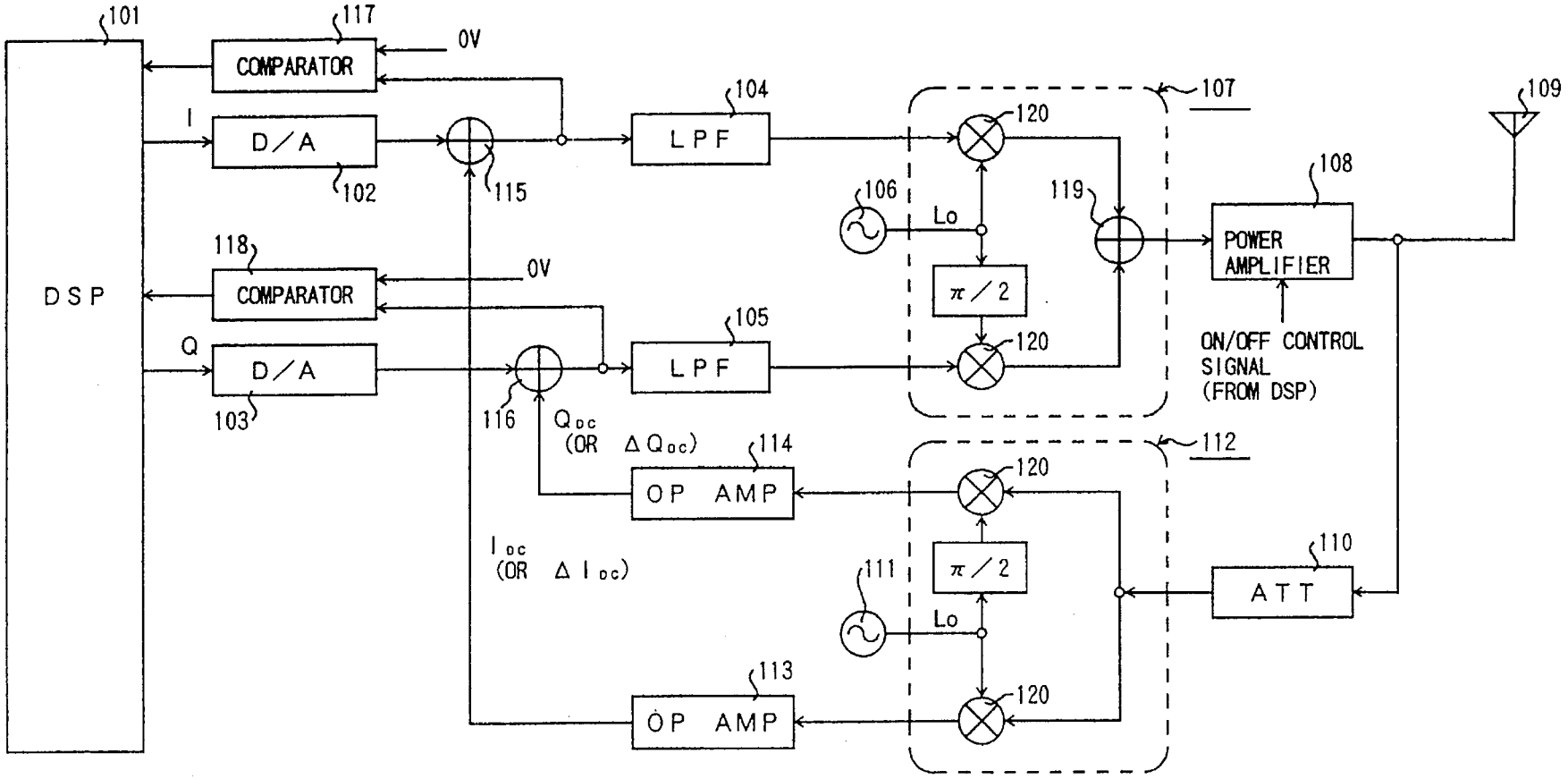
FIG. 1 is a drawing for explaining the configuration of a Cartesian loop transmitter in which the present invention is applied.

FIG. 1 shows an example of configuration of a Cartesian loop transmitter according to the present embodiment comprising a DSP 101 which executes such a processing for an input signal as band limitation, band division, and frequency shift, all required for tone in band generation and outputs the signal, dividing it to two signals I and Q crossing each other at right angles, D/A convertors 102, 103 which convert the output signals I, Q (digital signals) from the DSP 101 to analog signals respectively, an LPF (low pass filter) 104 into which the signal from the D/A convertor 102 is inputted together with a signal $I_{DC}$ from an operational amplifier 113, described later, and which subjects the signals to band limitation and then outputs the signals, an LPF 105 into which a signal from the D/A convertor 103 is inputted together with a signal DDC from an operational amplifier 114, described later, and which subjects the signals to band limitation and then outputs the signals, a local oscillator 106 which outputs a local signal (carrier wave) $L_O$, a quadrature modulator 107 into which signals from the LPFs 104, 105 and local oscillator 106 are inputted and which outputs, modulated wave after quadrature modulation, a power amplifier 108 which amplifies the modulated wave outputted from the quadrature modulator 107, an antenna 109 which transmits the modulated wave amplified in the power amplifier 108, an ATT (attenuator) 110 which detects only a progressive wave from the modulated wave amplified in the power amplifier 108 and executes attenuation for level adjustment, a local oscillator 111 which outputs a local signal (carrier wave) $L_O$, a quadrature modulator 112 into which signals from the ATT 110 and the local oscillator 111 are inputted and which subjects the signals to quadrature demodulation, an operational amplifier 113 which amplifies signals from the quadrature demodulator 112 and outputs a signal $I_{DC}$, an operational amplifier 114 which amplifies the signals from the DC demodulator 112 and outputs a signal QDC, an adder 115 which adds a signal from the D/A convertor 102 to a signal $I_{DC}$ from the operational amplifier 113, an adder 116 which adds a signal from the D/A convertor to a signal $Q_{DC}$ from the operational amplifier 114, a comparator 117 into which a signal from the adder 115 is inputted and which compares the voltage to 0 V, and a comparator 118 into which a signal from the adder 116 is inputted and which compares the voltage to 0 V. It should be noted that the reference numeral 119 indicates an adder and the reference numeral 120 indicates a multiplier. Also it should be noted that one local oscillator may be used for both the local oscillator 106 and the local oscillator 111.

With the configuration above, now description is made for operations for ① correction of a DC element in the quadrature demodulator 112, and ② suppression of carrier leak in the quadrature modulator 107 in this order.

① Correction of a DC element in the quadrature demodulator 112

At first, description is made for principles in correction of a DC element in the quadrature demodulator 112. DC elements in channels I, Q in the quadrature demodulator 112 are amplified by the operational amplifiers 113, 114 and are outputted as DC elements $I_{DC}$, $Q_{DC}$ from the operational amplifiers 113, 114. The DC elements $I_{DC}$, $Q_{DC}$ are passed through the LPFs 104, 105 together with the signals I, Q (digital signal based on data to be transmitted) converted by the D/A convertor 103 to analog signals, and are provided as input to the quadrature modulator 107. For this reason, the DC elements $I_{DC}$, $Q_{DC}$ are provided as carrier leak, an unnecessary frequency element, through the quadrature modulator 107. To remove the unnecessary element, the DC elements $I_{DC}$, $Q_{DC}$ generated by the quadrature demodulator 112 can be canceled by adding DC elements each having an equivalent value and a contrary sign to the DC elements $I_{DC}$, $Q_{DC}$ respectively to the I, Q channels from the DSP 101 through the D/A convertors 102, 103.

Figure 2:
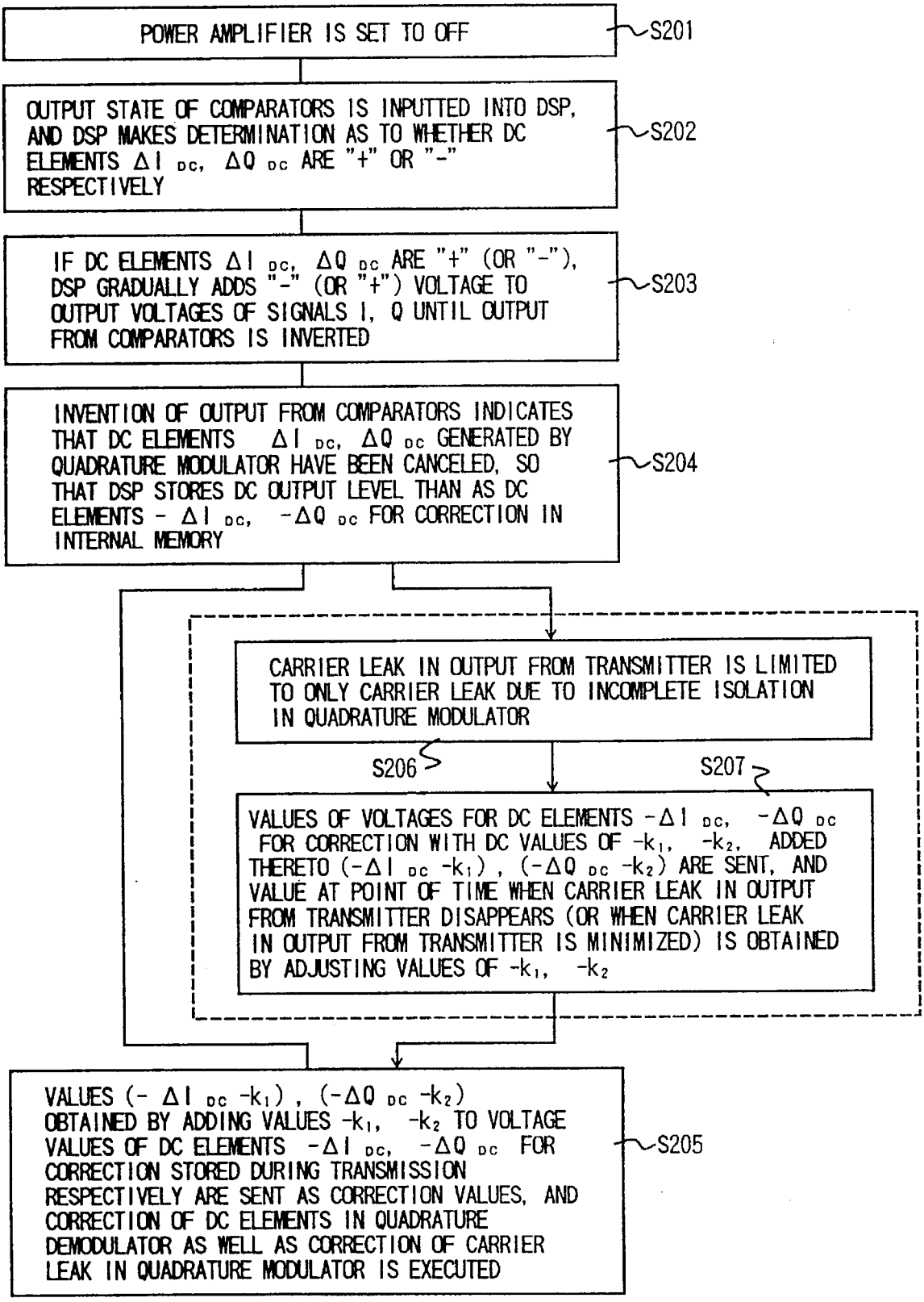
FIG. 2 is a drawing for explaining a process flow in the present invention.
Figure 3:
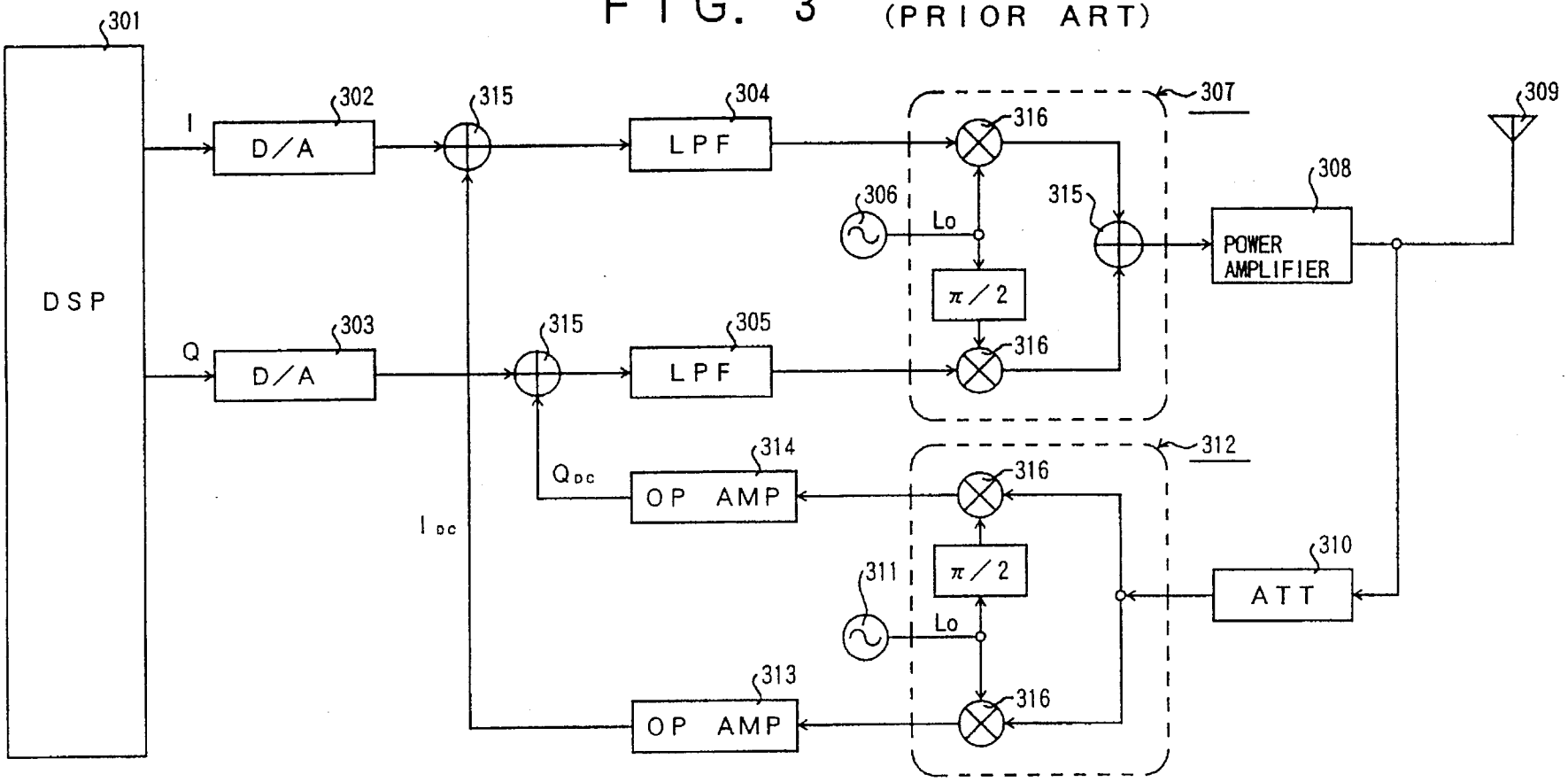
FIG. 3 (PRIOR ART)
FIG. 3 is a drawing for explaining the configuration of a conventional type of Cartesian loop transmitter.

Now description is made for concrete operations for correction of carrier leak according to the principle as described above with reference to a process flow shown in FIG. 2. At first, to exclude effects by other signals or elements, input to the quadrature demodulator 112 must be reduced to zero. For that purpose, the DSP 101 outputs an ON/OFF control signal to the power amplifier 108 to turn OFF the power amplifier 108 and disconnect the feedback system (S201). With this operation, input to the ATT 110 is eliminated, and only a carrier wave from the local oscillator 111 is inputted into the quadrature demodulator 112. In this state, only I, Q elements of the carrier wave amplified as described above are outputted as D elements $\Delta I_{DC}$, $\Delta Q_{DC}$ from the operational amplifiers 113, 114.

Then, an output state (High or Low) of the comparators 117, 118 is inputted into the DSP 101, and the DSP 101 makes a determination as to whether the DC elements $\Delta I_{DC}$, $\Delta Q_{DC}$ are "+" or "−" respectively (S202). In this step, if the DC elements $\Delta I_{DC}$, $\Delta Q_{DC}$ are "+" (or "−"), the DSP 101 gradually adds "−" (or "+") voltage to the output voltages of the signals I, Q until output from the comparators 117, 118 is inverted (S203).

Inversion of output from the comparators 117, 118 (High/Low→Low/High) indicates that the DC elements $\Delta I_{DC}$, $\Delta Q_{DC}$ generated by the quadrature modulator 107 have been canceled, so that the DSP 101 stores the DC output level then as DC elements $-\Delta I_{DC}$, $-\Delta Q_{DC}$ for correction in the internal memory (now shown herein) (S204).

Then, correction of the DC elements $I_{DC}$, $Q_{DC}$ in the quadrature demodulator 112 is executed using the DC elements $-\Delta I_{DC}$, $-\Delta Q_{DC}$ for correction stored during transmission (S205). It should be noted that in S205 the DC elements $-\Delta I_{DC}$, $-\Delta Q_{DC}$ for correction stored during transmission is used for correction of carrier leak due to incomplete isolation in the quadrature modulator 107, described later, as well as for the final correction $(-\Delta I_{DC}-k_1)$, $(-\Delta Q_{DC}-k_2)$.

As the DC elements $\Delta I_{DC}$, a $Q_{DC}$ in the quadrature demodulator 112 are very sensitive and vary according to temperature, the steps S201 to S204 are executed each time before transmission by a transmitter is started to measure and store the DC currents $-\Delta I_{DC}$, $-\Delta Q_{DC}$ for correction, and correction is executed by using the values.

② Suppression of carrier leak in the quadrature modulator 107

At first, description is made for principles in suppression of carrier leak in the quadrature 107. When correcting carrier leak in the quadrature 107, if carrier leak due to incomplete isolation in the quadrature modulator 107 is expressed by the expression of $(k_1 \cos(\omega t)+k_2 \sin(\omega t))$, it is possible to cancel carrier leak due to incomplete isolation in the quadrature modulator 107 by inputting $-k_1$, $-k_2$ respectively to I, Q channels at input terminals of the quadrature modulator 107.

However, as shown in FIG. 1, a signal with a signal from the DSP 101 as well as signals $I_{DC}$, $Q_{DC}$ from the operational amplifiers 113, 114 added thereto is being inputted into the I, Q channels at input terminals of the quadrature 107 in an actual circuit, so that the carrier leak in the quadrature modulator 107 generated due to the DC elements $I_{DC}$, $Q_{DC}$ in the I, Q channels due to incomplete isolation in the quadrature demodulator 112 can not be suppressed even if $-k_1$, $-k_2$ are outputted from the DSP 101 to the I, Q channels respectively to cancel carrier leak due to incomplete isolation in the quadrature modulator 107. For this reason, to completely suppress carrier leak in the quadrature modulator 107, it is necessary to provide correction values $(-\Delta I_{DC}-k_1)$, $(-\Delta Q_{DC}-k_2)$ including the DC elements $-\Delta I_{DC}$, $-\Delta Q_{DC}$ for correction of the DC elements $I_{DC}$, $Q_{DC}$ in the I, Q channels due to incomplete isolation in the quadrature demodulator 112 and also including correction values $(-k_1, -k_2)$ to carrier leak due to incomplete isolation in the quadrature modulator 107 as output from the DSP 101.

Next, description is made for concrete operations according to the principle described above with reference to the process flow shown in FIG. 2. At first, in FIG. 2, operations in the steps S201 to S204 are executed and the DC elements $-\Delta I_{DC}$, $-\Delta Q_{DC}$ for correction to cancel the DC elements $I_{DC}$, $Q_{DC}$ in the I, Q channels due to incomplete isolation in the quadrature demodulator 112 are measured.

Then, from the DSP 101, the DC elements $-\Delta I_{DC}$, $-\Delta Q_{DC}$ for correction are issued to cancel the DC elements $I_{DC}$, $Q_{DC}$ in the I, Q channels due to incomplete isolation in the quadrature demodulator 112, and carrier leak in output from a transmitter is limited to only carrier leak due to incomplete isolation in the quadrature modulator 107 (S206).

Then, values of voltages for the DC elements $-\Delta I_{DC}$, $-\Delta Q_{DC}$ for correction with DC values of $-k_1$, $-k_2$ added thereto $(-\Delta I_{DC}-k_1)$, $(-\Delta Q_{DC}-k_2)$ are sent as output from the I, Q channels of the DSP 101, and a value at a point of time when carrier leak in output from the transmitter disappears (or when carrier leak in output from the transmitter is minimized) is obtained by adjusting the values of $-k_1$, $-k_2$ (S207). Concretely, the values of $-k_1$, $-k_2$ are obtained by monitoring output from the quadrature modulator 107 with a spectrum analyzer from output from the I, Q channels of the DSP 101 $(-\Delta I_{DC}-k_1)$, $(-\Delta Q_{DC}-k_2)$ at a point of time when the carrier leak is minimized, and the values are stored in an internal memory (not shown herein) in the DSP 101.

Then, values $(-\Delta I_{DC}-k_1)$, $(-\Delta Q_{DC}-k_2)$ obtained by adding the values $-k_1$, $-k_2$ to the voltage values of the DC elements $-\Delta I_{DC}$, $-\Delta Q_{DC}$ for correction stored during transmission respectively are sent as correction values, and correction of the DC elements in the quadrature demodulator 112 as well as correction of carrier leak in the quadrature modulator 107 is executed (S205).

It should be noted that, as it is necessary to monitor carrier leak in output from a transmitter with a spectrum analyzer, in practical operations in S206, S207 above, adjustment is executed when shipped from a factory to obtain the values of $-k_1$ and $-k_2$, and the values are stored in an internal memory of the DSP 101.

As described above, in the present embodiment, the correction values $(-\Delta I_{DC}-k_1)$, $(-\Delta Q_{DC}-k_2)$ including the DC elements $-\Delta I_{DC}$, $-\Delta Q_{DC}$ for correction of the DC elements $I_{DC}$, $Q_{DC}$ in the I, Q channels due to incomplete isolation in the quadrature demodulator 112 and also including the correction values $(-k_1, -k_2)$ to carrier leak due to incomplete isolation in the quadrature modulator 107 are used, so that carrier leak in the quadrature modulator 107 is completely suppressed. Namely generation of carrier leak in a Cartesian loop transmitter can be suppressed and deterioration of communication quality can be reduced.

Also suppression of carrier leak is realized by using comparators and a DSP, so that any specific and expensive circuit is not required and a low price Cartesian loop transmitter can be provided.

Furthermore a temperature detecting sensor or the equivalent is provided in the quadrature modulator 107, values of $-k_1$, $-k_2$ each corresponding to each temperature are stored in correspondence to temperatures in the quadrature modulator 107, and appropriate values of $-k_1$, $-k_2$ are selected and used based on a temperature detected by the temperature detecting sensor, so that generation of carrier leak can be suppressed more completely.

Although a quadrature demodulator and a quadrature modulator are used in the present embodiment, the system configuration is not limited to this case, and the same effects can be achieved by using a general demodulator and a general modulator.

As described above, the method of correcting carrier leak in a transmitter according to the present invention comprises a first step of setting a first digital signal to a first specified value before start of transmission, a second step of causing output from a demodulator to respond only to output from a first local oscillator, a third step of comparing a third analog signal outputted from an adder to a second specified value and obtaining a result of comparison which is either a first state or a second state, a fourth step of gradually changing the first digital value from the first specified value until the result of comparison coincides with the first state or the second state and obtaining and storing a correction value indicating a difference between a value of the first digital signal and the first specified value at a point of time when the result of comparison coincides with either the first state or the second state, and a fifth step of causing the first digital signal obtained by executing correction of the data to be transmitted from the DSP according to the correction value stored in the fourth step, so that generation of carrier leak due to a demodulator can be suppressed and deterioration of communication quality can be reduced. Also any specific and expensive circuit or the equivalent is not required, and a low price transmitter can be realized.

In the method of correcting carrier leak in a transmitter according to the present invention, step 2 includes inhibiting the first supply circuit to supply a modulated wave amplified as described above, so that output from a demodulator can be caused to respond only to output from the first local oscillator.

In the method of correcting carrier leak in a transmitter according to the present invention, the demodulator above is a circuit including a quadrature demodulator, so that generation of carrier leak due to a quadrature demodulator can be suppressed and deterioration of communication quality can be reduced.

The method of correcting carrier leak in a transmitter according to the present invention also comprises a first step of setting a first digital value to a first specified value before start of transmission, a second step of causing output from a demodulator to respond only to output from a first local oscillator, a third step of comparing a third analog signal outputted from an adder to a second specified value and obtaining a result of comparison which is either a first state or a second state, a fourth step of gradually changing the first digital value from the first specified value until the result of comparison coincides with the first state or the second state and obtaining and storing a correction value indicating a difference between a value of the first digital signal and the first specified value at a point of time when the result of comparison coincides with either the first state or the second state, a fifth step of gradually changing the first digital signal from the first correction value, outputting the first digital signal to a modulation circuit, obtaining and storing a second correction value indicating a difference between the first digital signal and the first correction value at a point of time when carrier leak outputted from the modulation circuit is minimized, and a sixth step of causing the DSP to output the first digital signal obtained by subjecting data to be transmitted to correction according to the first correction value stored in the fourth step as well as to the second correction value stored in the fifth step during transmission, so that generation of carrier leak can be suppressed and deterioration of communication quality can be reduced. Also any specific and expensive circuit or the equivalent is not required, and a low price transmitter can be realized.

In the method of correcting carrier leak in a transmitter according to the present invention, the second step includes inhibiting the first supply circuit to supply a modulated wave amplified as described above, so that output from a demodulator can be caused only to output from the first local oscillator.

In the method of correcting carrier leak in a transmitter according to the present invention, the modulation circuit is a circuit including a quadrature modulator, so that generation of carrier leak due to a quadrature modulator can be suppressed and also deterioration of communication quality can be reduced.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A method of correcting carrier leak in a transmitter having, during transmission, a digital signal processor (DSP) outputting a first digital signal based on data to be transmitted, a D/A convertor converting the first digital signal to a first analog signal and outputting the analog signal, an adder adding the first analog signal to a second analog signal and outputting a third analog signal, a comparator comparing the third analog signal with a specified value, a modulation circuit converting the third analog signal to a modulated wave, a first supply circuit amplifying the modulated wave and supplying the modulated wave amplified to an antenna, a demodulation circuit demodulating a portion of the modulated wave amplified above according to an output from a first local oscillator, and a second supply circuit supplying an output from said demodulation circuit as the second analog signal to said adder, the method comprising:

a first step of setting the first digital signal to a first specified value, a second step of causing an output from said demodulation circuit to respond only to an output from said first local oscillator, a third step of comparing the third analog signal outputted from said adder to a second specified value and obtaining a result of comparison which is either one of a first state or a second state, a fourth step of gradually changing the first digital signal from the first specified value until the result of comparison coincides with either the first state or the second state and storing a correction value indicating a difference between a value of the first digital signal and the first specified value at a time when the result of comparison coincides with either the first state or the second state, all of said steps described above being executed before a start of transmission, and a fifth step of causing the first digital signal obtained by subjecting data to be transmitted to correction according to the correction value stored in said fourth step to be outputted from said DSP during the transmission.

2. A method of correcting carrier leak in a transmitter according to claim 1, wherein said demodulation circuit is a circuit including a quadrature demodulation circuit.

3. A method of correcting carrier leak in a transmitter according to claim 1, wherein said second step includes inhibiting said first supply circuit to supply the amplified modulated wave.

4. A method of correcting carrier leak in a transmitter having, during transmission, a digital signal processor (DSP) outputting a first digital signal based on data to be transmitted, a D/A convertor converting the first digital signal to a first analog signal and outputting the analog signal, an adder adding the first analog signal to a second analog signal and outputting a third analog signal, a comparator comparing the third analog signal with a specified value, a modulation circuit converting the third analog signal to a modulation wave, a first supply circuit amplifying the modulated wave and supplying the modulation wave amplified to an antenna, a demodulation circuit demodulating a portion of the modulation wave amplified above according to output from a first local oscillator, and a second supply circuit supplying an output from said demodulation circuit as the second analog signal to said adder, the method comprising:

a first step of setting the first digital signal to a first specified value, a second step of causing output from said demodulation circuit to respond only to the output from said first local oscillator, a third step of comparing the third analog signal outputted from said adder to a second specified value and obtaining a result of comparison which is either one of a first state or a second state, a fourth step of gradually changing the first digital signal from the first specified value until the result of comparison coincides with either the first state or the second state, and storing a first correction value indicating a difference between a value of the first digital signal and the first specified value at a time when the result of comparison coincides with either the first state or the second state, a fifth step of gradually changing the first digital value from the first correction value, outputting the first digital signal to said modulation circuit, obtaining and storing a second correction value indicating a difference between a value of the first digital signal and the first correction value at a time when carrier leak outputted from said modulation circuit is minimized, all of said steps described above executed before start of transmission, and a sixth step of causing the first digital signal obtained by subjecting data to be transmitted to correction according to the first correction value stored in said fourth step as well as to the second correction value stored in said fifth step to be outputted from said DPS during the transmission.

5. A method of correcting carrier leak in a transmitter according to claim 4, wherein said modulation circuit is a circuit including a quadrature modulator.

6. A method of correcting carrier leak in a transmitter according to claim 4, wherein said second step includes inhibiting said first supply circuit to supply the amplified modulated wave.

7. A transmitter comprising:

a digital signal processor for generating first and second input signals separated in phase by 90°, a first local oscillator for generating a first carrier wave signal, a second local oscillator for generating a second carrier wave signal, a quadrature modulator responsive to said first and second input signals and said first carrier wave signal for generating a modulated signal, an antenna responsive to said modulated signal for radiating a transmitted signal, a quadrature demodulator responsive to said modulated signal and said second carrier wave signal for generating first and second demodulated signals, a first adding circuit responsive to said first input signal and said first demodulated signal for generating a first resultant signal, a second adding circuit responsive to said second input signal and said second demodulated signal for generating a second resultant signal, a first comparator responsive to said first resultant signal and a first reference signal for supplying said digital signal processor with a first feedback signal to adjust said first input signal, and a second comparator responsive to said second resultant signal and a second reference signal for supplying said digital signal processor with a second feedback signal to adjust said second input signal.

8. The transmitter of claim 7 further comprising a power amplifier coupled to an output of said quadrature modulator.

9. The transmitter of claim 8, wherein said digital signal processor supplies said power amplifier with a control signal to prevent said modulated signal from being supplied to said quadrature demodulator.

* * * * *